US006326114B1

(12) United States Patent
Itakura et al.

(10) Patent No.: US 6,326,114 B1
(45) Date of Patent: Dec. 4, 2001

(54) TONER, AND PROCESS FOR PRODUCING A TONER

(75) Inventors: Takayuki Itakura; Masaaki Taya, both of Mishima; Wakashi Iida; Junko Yoshikawa, both of Numazu; Nobuyoshi Sugahara, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/549,193

(22) Filed: Apr. 13, 2000

(30) Foreign Application Priority Data

Apr. 14, 1999 (JP) ..... 11-106065

(51) Int. Cl.[7] ..... G03G 9/097

(52) U.S. Cl. ..... 430/108.3; 430/109.4; 430/137.18; 430/137.2

(58) Field of Search ..... 430/110, 109, 430/108.1, 109.4, 108.3, 137.18, 137.2

(56) References Cited

U.S. PATENT DOCUMENTS

| | | | | |
|---|---|---|---|---|
| 2,297,691 | | 10/1942 | Carlson | 95/5 |
| 2,357,809 | | 9/1944 | Carlson | 95/11 |
| 4,478,923 | * | 10/1984 | DeRoo et al. | 430/109 |
| 4,935,327 | * | 6/1990 | Takizawa et al. | 430/109 |
| 5,143,809 | | 9/1992 | Kaneko et al. | 430/105 |
| 5,346,792 | | 9/1994 | Kobayashi et al. | 430/109 |
| 5,607,804 | | 3/1997 | Semura et al. | 430/106.6 |
| 5,665,513 | | 9/1997 | Ida et al. | 430/110 |
| 5,700,617 | | 12/1997 | Takiguchi et al. | 430/110 |
| 5,747,209 | | 5/1998 | Takiguchi et al. | 430/106.6 |
| 5,827,631 | * | 10/1998 | Yoshihara et al. | 430/110 |
| 5,851,714 | * | 12/1998 | Taya et al. | 430/110 |

FOREIGN PATENT DOCUMENTS

| | | | |
|---|---|---|---|
| 0259642 | | 3/1988 | (EP) . |
| 0632336 | | 1/1995 | (EP) . |
| 57-124740 | * | 8/1982 | (JP) . |
| 57124740 | | 8/1982 | (JP) . |
| 61213858 | | 9/1986 | (JP) . |
| 1-172973 | * | 7/1989 | (JP) . |
| 1-172975 | * | 7/1989 | (JP) . |
| 01246560 | | 10/1989 | (JP) . |
| 1-246560 | * | 10/1989 | (JP) . |
| 03203746 | | 9/1991 | (JP) . |
| 0424648 | | 1/1992 | (JP) . |
| 06175395 | | 6/1994 | (JP) . |

* cited by examiner

*Primary Examiner*—Christopher Rodee
(74) *Attorney, Agent, or Firm*—Fitzpatrick, Cellar, Harper & Scinto

(57) ABSTRACT

A toner includes at least a polyester resin having a carboxyl group, a coloring agent, 0.1–10 mass % of a metal salicylate compound with respect to a mass of the toner and 20–400 ppm of a hindered phenol with respect to the mass of the toner.

41 Claims, 4 Drawing Sheets

TONER, AND PROCESS FOR PRODUCING A TONER

BACKGROUND OF THE INVENTION

1. Field of the Invention

The present invention relates to a toner used for developing an electrostatic latent image formed in an image forming method, such as an electrophotographic method, an electrostatic recording method or an electrostatic printing method, a toner used in an image forming method according to a toner jet recording method, and a process for producing a toner.

2. Description of the Related Art

As described, for example, in U.S. Pat. Nos. 2,297,691 and 2,357,809, an electrophotographic method is a method for forming an image by uniformly charging a photoconductive insulating layer, exposing the layer, forming an electrostatic latent image, developing the electrostatic latent image by a toner (a developing process), transferring the obtained toner image onto a transfer material, such as transfer paper, via an intermediate transfer member, or without using an intermediate transfer member (a transfer process), and fixing the toner image on the transfer material according to a heating fixing method, a pressing fixing method, or a heating/pressing fixing method (a fixing process).

Since image formation is performed through various processes as described above, the toner for forming a toner image must have functions required in the developing process, the transfer process, and the fixing process.

In general, since the toner receives a mechanical frictional force due to a shearing force and an impact force received during a mechanical operation within a developing device, it tends to be degraded during copying or printing operations for several to several tens of thousands of sheets. In order to prevent such degradation of the toner, a tough binding resin having a large molecular weight capable of resisting a mechanical frictional force may be used. In general, a binding resin having a large molecular weight has a high softening point. Hence, in order to sufficiently fix a toner image in a heat-roller fixing method which is widely being used because of a contact fixing method and excellent thermal efficiency, a heat roller must be set to a high temperature. A high temperature of the heat roller will cause degradation of the fixing device itself, the generation of curl of paper after fixing, and an increase in energy consumption. Furthermore, since such a binding resin also has poor grindability, the efficiency in manufacture of the toner decreases.

As described above, the heat-roller fixing method has superior thermal efficiency because the surface of a heating roller is in pressure contact with the toner-image surface of a transfer material, and therefore is widely used in a wide range of machines from low-speed machines to high-speed machines. In the heat-roller fixing method, however, when the surface of the heating roller contacts the toner-image surface, an offset phenomenon tends to occur in which the toner adheres to the surface of the heating roller and the adhering toner is transferred onto the succeeding transfer material.

In order to improve an offset resisting property of a toner, there have been proposed toners which use a covalent cross-linking resin or a branching resin using a multifunctional monomer, called a cross-linking polymer, or a multifunctional initiator (described in Japanese Patents Laid-Open Application (Kokai) Nos. 3-203746 (1991) and 4-24648 (1992)), and toners which use an ionic cross-linking polymer obtained by strongly bonding a metal oxide and a polymer (described in Japanese Patents Laid-Open Application (Kokai) Nos. 61-213858 (1986) and 6-175395 (1994)). Although the offset resisting property is improved in these toners, the fixability of the binding resin itself is degraded. Furthermore, since polymer molecules are strongly bonded to each other, resin components due to cross-linking represented by tetrahydrofuran-insoluble matter cause difficulty of dispersion of a coloring agent or a charge control agent into a binding resin, and degrade the grindability of a toner mixture during manufacture of a toner.

In general, since the minimum fixing temperature is between low-temperature offset and high-temperature offset, the usable temperature range is between the minimum fixing temperature and high-temperature offset. By reducing the minimum fixing temperature and increasing the temperature of generation of high-temperature offset as much as possible, it is possible to reduce the fixing temperature and to widen the usable temperature range. As a result, it is possible to realize energy saving and high-speed fixing, and prevent the occurrence of curl of a sheet. Since curl of a sheet can be suppressed, it is possible to perform copying on two surfaces, and realize an intelligent copier, precise temperature control of a fixing device, and mitigation of allowance.

For that purpose, a toner having fixability at a low-temperature and an excellent offset resisting property is desired.

Recently, in accordance with spread of use of computer apparatuses for personal users, full-color image communication has been widely utilized as an information transmission mechanism using images. Under such circumstances, full-color approach has also been rapidly adopted in printers and copiers, serving as output apparatuses, particularly in low-grade apparatuses, so that color images are becoming familiar to ordinary users.

In full-color approach, colors are reproduced using toners of three colors, i.e., yellow, magenta and cyan which are three primary colors, or toners of four colors including black in addition to the three colors. For example, an electrostatic latent image for magenta is formed on a photoconductive layer by passing light from an original through a color-separation-light transmitting filter in a relationship of a complementary color with magenta (a latent-image forming process). Then, a magenta toner image is held on a supporting member after passing through a developing process and a transfer process using a magenta toner. These processes are sequentially performed also for a cyan toner, a yellow toner and a black toner. The color toners are superposed on the same supporting member by being subjected to registration, and a final full-color image is obtained by fixing the superposed images.

Particularly in color toners, it is important that the fixed color image is in a state of substantially complete fusion such that the shapes of toner particles can be hardly discriminated, so as not to hinder color reproduction due to irregular reflection of light, and that a color toner is transparent so as not to hinder the color tone of a layer of a color toner having a different color tone present below the first-cited color toner, and that each color toner has a hue and a spectral reflectance in good balance and a sufficient saturation.

Many binding resins are being studied from the above-described viewpoint, and a color toner satisfying the above-described characteristics is expected. Nowadays, polyester-type resins are widely used in the concerned technical field as binding resins for color toners.

Japanese Patent Laid-Open Application (Kokai) No. 57-124740 (1982) describes that, in order to suppress reaction of free radicals during synthesis of a binding resin, it is desirable to add a hindered-phenol-type antioxidant by a total amount of 0.1–3.0 weight % with respect to a high-molecular polymer.

On the other hand, Japanese Patent Laid-Open Application (Kokai) No. 1-246560 (1989) describes that, in order to suppress the oxidation of both a toner using a binding resin, and a photosensitive member comprising an organic photoconductor, it is desirable to add a hindered-phenol-type antioxidant by a total amount of 0.01–10 weight % with respect to the toner during mixture of materials before manufacturing the toner by fusing and kneading the binding resin with other materials.

However, the effect of addition of such a hindered-phenol-type antioxidant is not realized in all toners and toner-manufacturing methods. When adding such an antioxidant to a toner having the configuration of the present invention, it is necessary to pay close attention to the amount of addition and the method of manufacturing the toner.

SUMMARY OF THE INVENTION

It is an object of the present invention to provide a toner which can be fixed at a lower fixing temperature while maintaining a sufficient offset resisting property, and a method for manufacturing such a toner.

It is another object of the present invention to provide a toner which substantially maintains the initial developing property without causing coagulation even after being left for a long time period, and a method for manufacturing such a toner.

It is still another object of the present invention to provide a toner which has stable charging characteristics irrespective of environments of an ordinary temperature/an ordinary humidity, a high temperature/a high humidity, and a low temperature/a low humidity, and which can very faithfully develop an electrostatic latent image, and a method for manufacturing such a toner.

According to one aspect, the present invention which achieves these objectives relates to a toner comprising at least a polyester resin having carboxyl groups, a coloring agent, 0.1–10 weight % of a metal salicylate compound with respect to the total weight of the toner, and 20–400 ppm of hindered phenol with respect to the total weight of the toner.

According to another aspect, the present invention which achieves these objectives relates to a process for producing a toner containing at least toner particles, comprising: a melt-kneading step for melt-kneading a mixture including at least a polyester resin having a carboxyl group and containing a hindered phenol, a coloring agent, and a metal salicylate compound to obtain a melt-kneaded product, wherein said polyester resin is synthesized under the presence of a hindered phenol; a cooling step for cooling the melt-kneaded product, and a pulverizing step for pulverizing the cooled product to obtain toner particles; wherein said toner comprises at least said polyester resin having a carboxyl group; and said coloring agent; 0.1–10 weight % of the metal salicylate compound with respect to the total weight of the toner, and 20–400 ppm of the hindered phenol with respect to a mass of the toner.

According to still another aspect, the present invention which achieves these objectives relates to a process for producing a toner containing at least toner particles, comprising: a melt-kneading step for melt-kneading a mixture including at least a hindered phenol, a polyester resin having a carboxyl group, a coloring agent and a metal salicylate compound to obtain a melt-kneaded product; a cooling step for cooling the melt-kneaded product; and a pulverizing step for pulverizing the cooled product to obtain toner particles; wherein said toner comprises at least said polyester resin having a carboxyl group; and said coloring agent; 0.1–10 weight % of the metal salicylate compound with respect to the total weight of the toner; and 20–400 ppm of the hindered phenol with respect to the total weight of the toner.

The foregoing and other objects, advantages and features of the present invention will become more apparent from the following detailed description of the invention taken in conjunction with the accompanying drawings.

DETAILED DESCRIPTION OF THE INVENTION

The inventors of the present invention have obtained the knowledge that a toner having excellent fixability, long-term preservability, and charging stability can be obtained when the toner includes at least a polyester resin having a carboxyl group, a coloring agent, a metal salicylate compound and 20–400 ppm of a hindered phenol with respect to the mass of the toner, and have made the present invention. The present invention will now be described in detail.

In the present invention, the binding resin for toner particles is a polyester resin having a carboxyl group.

A polyester resin having a carboxyl group is used as the binding resin for the toner used in the present invention. Particularly, a polyester resin having a molecular structure indicated by the following expression (A) is preferable.

(A)

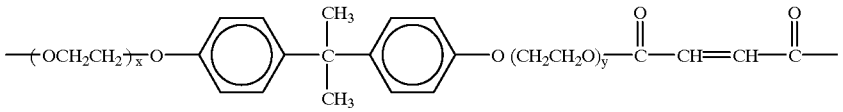

(in expression (A), x and y represent integers equal to or more than 1, and the average value of x+y is within a range of 2–4).

The polyester resin having the molecular structure indicated by expression (A) can easily form a metal-ion cross-linking structure when being melt/kneaded simultaneously with a metal salicylate compound (to be described in detail later), and can excellently form a toner having a distinct minimum value ($G'_{min}$) in the curve of the storage modulus of the toner.

Figure 1:
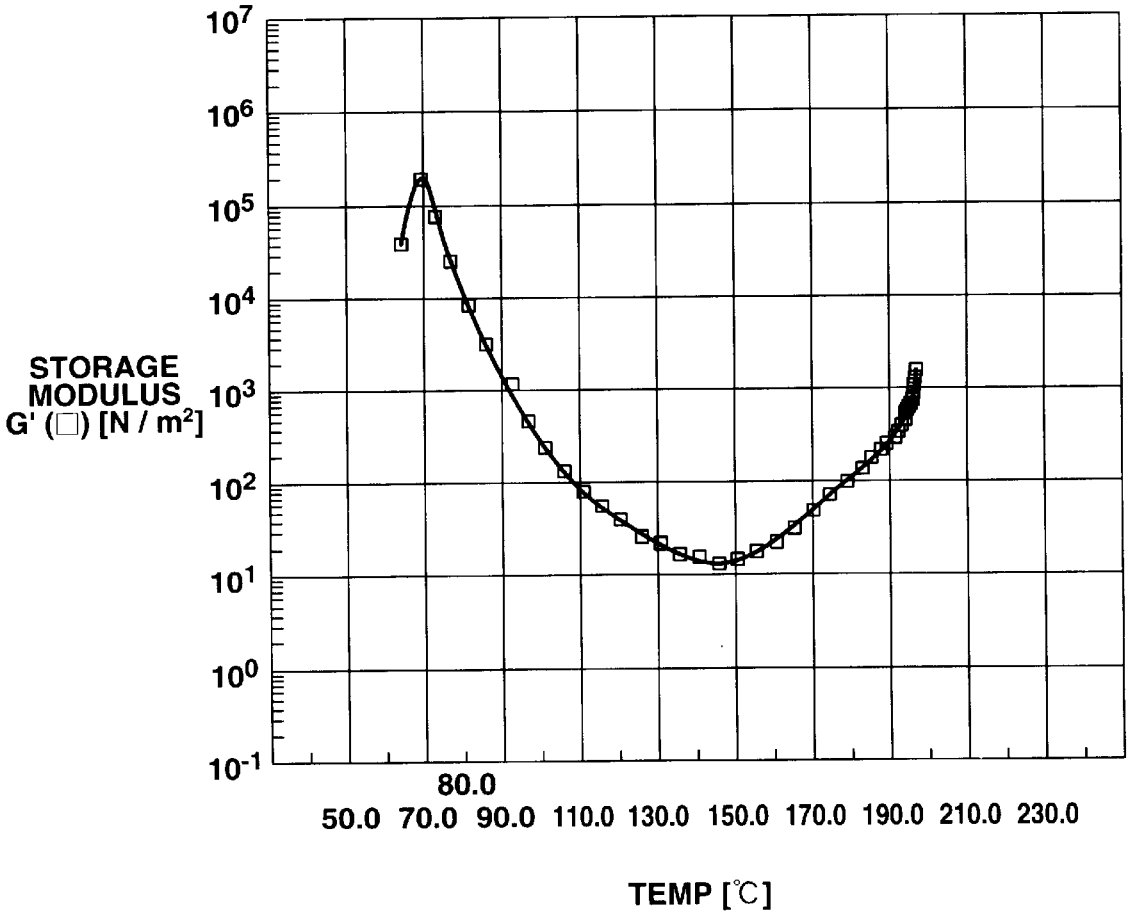
FIG. 1 is a graph illustrating the curve of a storage modulus of a toner according to the present invention.

For example, FIG. 1 illustrates an example of the curve of the storage modulus of a toner according to the present invention. This curve has a minimum value ($G'_{min}$) at about 145° C., and the viscoelasticity of the toner again increases at temperatures higher than the minimum value ($G'_{min}$). A toner having such a characteristic of viscoelasticity is superior in the high-temperature-offset resisting property. The minimum value ($G'_{min}$) of the storage modulus of the toner is preferably within a range of 100–200° C., and more preferably within a range of 110–170° C.

Figure 2:
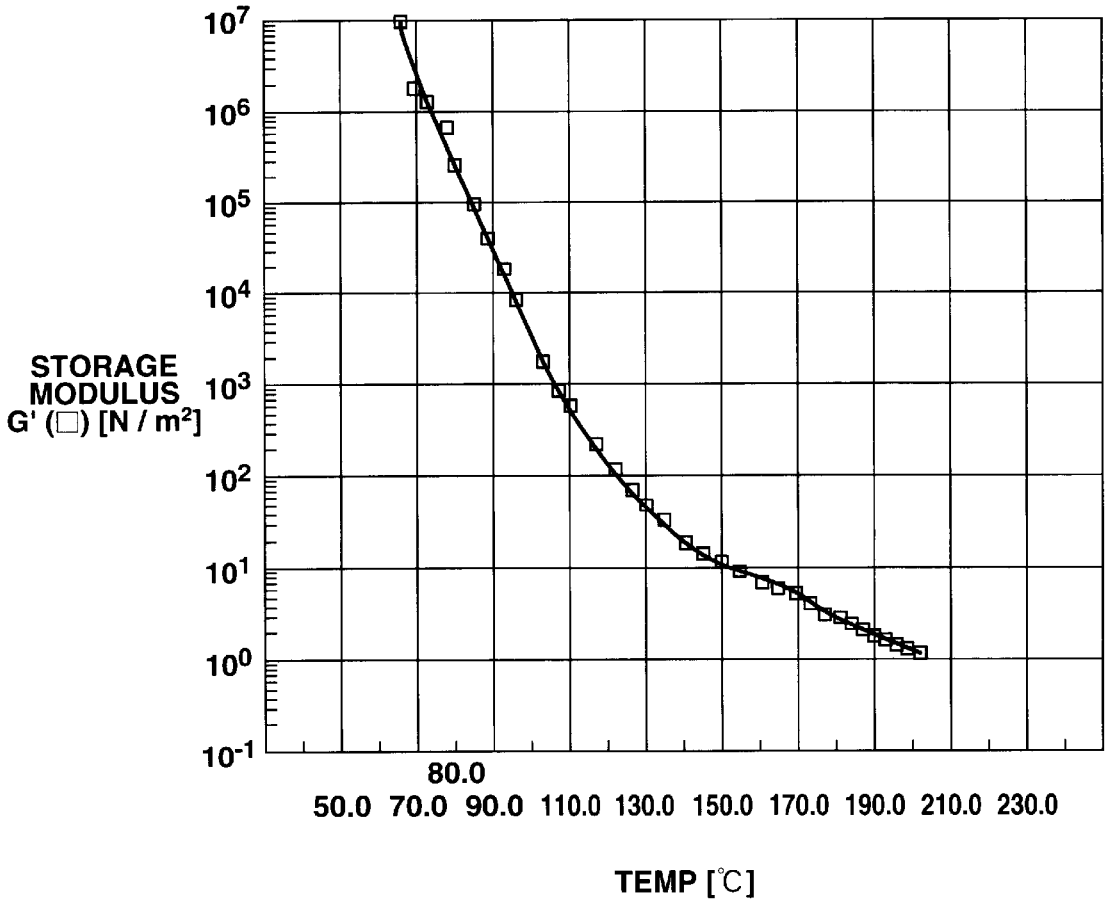
FIG. 2 is a graph illustrating the curve of a storage modulus of a conventional toner.

On the other hand, a toner similar to a comparative toner (to be described later) having viscoelasticity as shown in FIG. 2 does not have a distinct minimum value within a range of 100–200° C., and the storage modulus of the toner decreases at a high-temperature side higher than 100° C. in accordance with temperature rise. Such a toner is inferior in the high-temperature-offset resisting property, and has a narrower fixable-temperature range than the toner of the present invention.

Although the reason why the molecular structure represented by expression (A) reacts on a metal salicylate compound is not completely cleared, it is considered that a bending property peculiar to molecular chains of this structure easily forms a conformation apt to be interacted (a molecular configuration interaction), and that an electron donative property of phenyl groups having an electron donative property at a P position and a π-electron donative property of —CH═CH—greatly contribute to this phenomenon.

Bivalent alcohol components for generating a polyester resin include, for example, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, bisphenol hydroxide A, and a bisphenol derivative expressed by the following expression (B):

(B)

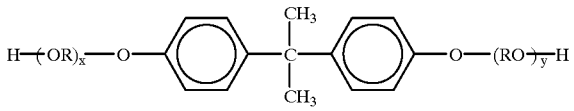

(in expression (B), R represents an ethylene or propylene group, x and y represent integers equal to or more than 1, and the average value of x+y is a value within a range of 2–10).

Trivalent or higher-valent alcohol components for forming a nonlinear polyester resin include, for example, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylol ethane, trimethylol propane, and 1,3,5-trihydroxybenzene. The amount of use of triatomic or higher-order alcohol is preferably within a range of 0.1–1.8 mol % with reference to the entire monomer.

Bivalent acid components for generating a polyester resin include, for example, aliphatic-acid-component monomers, such as fumaric acid, maleic acid, maleic anhydride, succinic acid, adipic acid, sebacic acid, malonic acid, and each monomer obtained by replacing one of these acids with saturated or unsaturated hydrocarbon radicals having a number of carbons within a range of 8–22, and aromatic-acid-component monomers, such as phthalic acid, isophthalic acid, phthalic anhydride, terephthalic acid, and each ester derivative of one of these acids.

Trivalent or higher-valent carboxylic acid components for forming a nonlinear polyester resin include, for example, 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, and each anhydride and ester compound of one of these acids. The amount of use of a trivalent or higher-valent carboxylic acid is preferably within a range of 0.1–1.9 mol % with reference to the entire monomer.

In the present invention, the glass transition temperature of the polyester resin is within a range of 47–64° C., and more preferably within a range of 49–62° C. The glass transition temperature of the toner is within a range of 50–67° C., and preferably within a range of 51–64° C.

When the glass transition temperature of the polyester resin is less than 47° C., or the glass transition temperature of the toner is less than 50° C., although fixability is excellent, the offset resisting property is degraded, thereby causing contamination of the fixing roller and winding of the sheet around the fixing roller may occur. Furthermore, the surface of the obtained image after fixing is too glossy, thereby degrading the quality of the image.

When the glass transition temperature of the polyester resin exceeds 64° C., or the glass transition temperature of the toner exceeds 67° C., fixability is degraded, so that the fixing temperature must be raised. As a result, the obtained image has generally poor glossiness, and a color mixing property of the toner as a full-color toner is degraded.

In the present invention, it is preferable that the number average molecular weight (Mn) and the weight average molecular weight (Mw) of a THF(tetrahydrofuran)-soluble component of the polyester resin in GPC (gel permeation chromatography) measurement are within a range of 1,300–9,500 and within a range of 5,500–95,000, respectively, and the ratio of Mw to Mn (Mw/Mn) of the THF-soluble component of the polyester resin is within a range of 2–10.

It is also preferable that the number-average molecular weight (Mn) and the weight-average molecular weight (Mw) of a THF-soluble component of the toner including the polyester resin in GPC measurement are within a range of 1,500–10,000 and within a range of 6,000–100,000, respectively, and the ratio of Mw to Mn (Mw/Mn) of the THF-soluble component of the toner is within a range of 2–10.

When the number-average molecular weight (Mn) or the weight-average molecular weight (Mw) of the THF-soluble component of the polyester resin is less than 1,300 or less than 5,500, respectively, and when the number-average molecular weight or the weight-average molecular weight of the THF-soluble component of the toner is less than 1,500 or less than 6,000, respectively, although the smoothness of the surface of the fixed image is high and the image looks clear, high-temperature offset tends to occur after repeated image forming operations, and stability during storage for a long time is degraded. In addition, the toner may be fused within the developing device, or so-called carrier spend in which toner components adhere to the surfaces of carrier particles, may be generated. Furthermore, since it is difficult to effectively shear during melt-kneading of toner materials in the manufacture of color toner particles, the dispersing property of the coloring agent tends to be degraded. As a result, the tinting strength of the toner tends to decrease, and the amount of charging of the toner tends to vary.

When the number-average molecular weight (Mn) or the weight-average molecular weight (Mw) of the THF-soluble component of the polyester resin exceeds 9,500 or 95,000, respectively, or when the number-average molecular weight (Mn) or the weight average molecular weight (Mw) of the THF-soluble component of the toner exceeds 10,000 or 100,000, respectively, although the offset resisting property of the polyester resin or the toner is excellent, the fixing temperature must be raised. Furthermore, even if the degree of dispersion of the pigment can be controlled, the smoothness of the surface at an image portion is degraded, and color reproducibity tends to be degraded.

When the ratio Mw/Mn of the THF-soluble component of the polyester resin or the toner is less than 2, since the molecular weight itself of the obtained polyester resin is generally small, the phenomenon of high-temperature offset after repeated image forming operations, degradation in stability during storage for a long time, fusion of the toner within the developing device, and carrier spend tend to occur, as in the above-described case of a small molecular weight. In addition, the amount of charging of the toner tends to vary.

When the ratio Mw/Mn of the THF-soluble component of the polyester resin or the toner exceeds 10, although an excellent high-temperature-offset resisting property is provided, the fixing temperature must be high. Furthermore, even if the degree of dispersion of the pigment can be controlled, the smoothness of the surface at an image portion is degraded, and color reproducibility tends to be degraded.

In the present invention, the polyester resin preferably includes the THF-insoluble component within a range of 0.1–10 weight %, and more preferably, within a range of 0.5–8 weight %. The toner preferably includes the THF-insoluble component within a range of 0.2–18 weight %, and more preferably within a range of 0.6–16 weight %.

In the present invention, when melt-kneading a polyester resin and a metal salicylate compound together with other additives, cross-linking of the polyester resin and the metal salicylate compound during melt-kneading occurs. Hence, the THF-insoluble component increases when manufacturing a toner.

The polyester resin according to the present invention has carboxylic groups, and preferably has an acid value within a range of 5–60 mg KOH/g, and more preferably within a range of 7–50 mg KOH/g.

When the acid value of the polyester resin is less than 5 mg KOH/g, the amount of charging tends to increase during repeated image forming operations, thereby causing so-called charge-up. On the other hand, when the acid value of the polyester resin exceeds 60 mg KOH/g, so-called charge-down tends to occur when performing repeated image forming operations in a high-temperature/high-humidity environment.

A trivalent or higher-valent metal is preferable as a metal for forming the metal salicylate compound used in the present invention. Bivalent metals include $Mg^{2+}$, $Ca^{2+}$, $Sr^{2+}$, $Pb^{2+}$, $Fe^{2+}$, $Co^{2+}$, $Ni^{2+}$, $Zn^{2+}$, and $Cu^{2+}$. $Zn^{2+}$, $Ca^{2+}$, $Mg^{2+}$, and $Sr^{2+}$ are preferable as bivalent metals. Trivalent of higher-valent metals include $Al^{3+}$, $Cr^{3+}$, $Fe^{3+}$, and $Ni^{3+}$. $Al^{3+}$ and $Cr^{3+}$ are preferable from among these metals, and $Al^{3+}$ is particularly preferable.

In the present invention, an aluminum compound of di-tert-butylsalicylate acid is particularly preferable as an organometallic compound.

The metal salicylate compound may be synthesized, for example, by dissolving salicylic acid in an aqueous solution of sodium hydroxide, dripping an aqueous solution fusing metallic atoms having a valence equal to or more than 2 into the aqueous solution of sodium hydroxide, heating and stirring the resultant solution, adjusting pH of the aqueous solution, cooling the solution to the room temperature, and filtering and washing the solution. However, the synthesizing method is not limited to the above-described one.

It is preferable to use a metal salicylate compound to an amount within a range of 0.1–10 weight % (more preferably within a range of 0.5–9 weight %) with respect to the total weight of the toner, because initial variations in the amount of charging of the toner are small, and the absolute amount of charging necessary during development can be easily obtained, so that a decrease in the quality of the obtained image, such as fog, or a decrease in the density of the image, does not occur.

The hindered phenol used in the present invention is a phenolic compound having a substitutional group at least at an ortho position for a hydroxyl group. Preferred hindered phenols include catechol and substituted catechols and hydroquinone and substituted hydroquinones.

Hindered phenols which can be used in the present invention include, for example, mono-t-butyl-p-cresol, mono-t-butyl-m-cresol, 4-t-butylcatechol, 2,5-di-t-butylhydroquinone, 2,5-di-t-amylhydroquinone, propyl gallate, 4,4'-methylenebis(2,6-t-butylphenol), 4,4'-isopropylidenebis(2,6-di-t-butylphenol), 4,4'-butylidenebis (3-methyl-6-t-butylphenol), butylhydroxyanisole, 2,6-di-t-butyl-p-cresol, 2,6-di-t-butylphenol, 2,6-di-t-butyl-4-ethylphenol, 2,4,6-tri-t-butylphenol, 4-hydroxymethyl-2,6-di-t-butyl, octadecyl-3-(4-hydroxy-3',5'-di-t-butylphenol) propionate, distearyl(4-hydroxy-3-methyl-5-t-butyl) benzylmalonate, 6-(4-hydroxy-3,5-di-t-butylanilino)2,4-bisoctylthio-1,3,5-triazine, 2,6-diphenyl-4-octadecanoxyphenol, 2,2'-methylenebis(4-methyl-6-t-butylphenol), 2,2'-methylenebis(4-methyl-6-t-butylphenol), 2,2'-isobutylidenebis(4,6-dimethylphenol), 2,2'-dihydroxy-3,3'-di-(α-methylcyclohexyl)-5,5'-dimethyldiphenylmethane, 2,2'-methylenebis-(4-methyl-6-cyclohexylphenol), tris[β-(3,5-di-t-butyl-4-hydroxyphenyl) proprionyloxyethyl]isocyanurate, 1,3,5-tris(2,6-dimethyl-3-hydroxy-4-t-butylbenzyl)isocyanurate, tris(3,5- di-t-butyl-4-hydroxyphenol)isocyanurate, 1,1,3'-tris(2-methyl-4-hydroxy-5-t-butylphenyl)butane, 2,6-bis-(2'-hydroxy-3'-t-butyl-5-methylbenzyl)4-methylphenol, N,N'-hexamethylenebis(3,5-di-t-butyl-4-hydroxyhydrocinnamate), hexamethyleneglycolbis[β-(3,5-di-t-butyl-4-hydroxyphenyl)propionate, triethyleneglycolbis (β-3-t-butyl-5-methyl-4-hydroxyphenyl)propionate, and tetrakis[methylene-3-(3,5-di-t-butyl-4-hydroxyphenyl) propionate]methane.

Particularly, 4-t-butylcatechol and 2,5-di-t-butylhydroquinone are preferable from among these compounds.

The hindered phenol is included within a range of 20–400 ppm with reference to the total weight of the toner, and preferably within a range of 50–380 ppm.

When the contained amount of the hindered phenol is less than 20 ppm with reference to the total weight of the toner, a polymerization inhibiting function during synthesis of the polyester resin, and an oxidation inhibiting function for the surfaces of toner particles and the organic photoconductor do not operate.

On the other hand, in the present invention, in the case of the toner manufactured by utilizing cross-linking (loose ionic bond) during mixing/kneading the polyester resin having carboxylic groups and the metal salicylate compound, when the contained amount of the hindered phenol exceeds 400 ppm with reference to the total weight of the toner, for example, in the curve of the storage modulus according to the present invention shown in FIG. 1, a distinct minimum value is not present within a temperature range of 100–200° C., and the storage modulus of the toner decreases as the temperature is raised at the high-temperature side.

It is considered that this is because the loose ionic bond between the molecular structure of the polyester resin and the metal salicylate compound is hindered when the contained amount of the hindered phenol exceeds 400 ppm with reference to the total weight of the toner. As a result, the high-temperature-offset resisting property is degraded, the range of the fixable temperature is narrowed, and the long-term preservability of the toner is greatly degraded. When using such a toner as a full-color toner, the dispersion of the coloring agent and the charge control agent is degraded, so that the transmittance of the toner is reduced, and the amount of charging tends to vary.

As described above, it is important to control the amount of the hindered phenol included in the toner of the present invention. At the same time, when the ratio of the content of the hindered phenol to the content of the metal salicylate compound included in the toner deviates from an appropriate range, a very big problem will arise.

When the amount of the hindered phenol and the amount of the metal salicylate compound contained in the toner are represented by H (mass part) and S (mass part), respectively, it is preferable that the following relationship is satisfied:

$$S:H\times10^4=1:5-1:4{,}000.$$

When the ratio is less than 1:5, a polymerization inhibiting function during synthesis of the polyester resin, and an oxidation inhibiting function for the surfaces of toner particles and the organic photoconductor cannot sufficiently be obtained.

When the ratio exceeds 1:4,000, the high-temperature resisting property tends to be degraded, the range of the fixable temperature tends to be narrowed, and the long-term perservability of the toner tends to be degraded.

Pigments and/or dies may be used as the coloring agents.

The dyes include, for example, C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6.

The pigments include, for example, Mineral Fast Yellow, Navel Yellow, Naphthol Yellow S, Hansa Yellow G, Permanent Yellow NCG, Tartrazine Lake, Molybdenum Orange, Permanent Orange GTR, Pyrazolone Orange, Benzidine Orange G, Cadmium Red, Permanent Red 4R, Watching Red Calcium Salt, Eosin Lake, Brilliant Carmine 3B, Manganese Purple, Fast Violet B, Methyl Violet Lake, Cobalt Blue, Alkali Blue Lake, Victoria Blue Lake, Phthalocyanine Blue, Fast Sky Blue, Indanthrene Blue BC, Pigment Green B, Malachite Green Lake, and Final Yellow Green G.

When using the toner as a full-color toner, coloring pigments for magenta include C.I. Pigment Reds, 1, 2, 3, 4, 5, 6, 7, 8, 9, 10, 11, 12, 13, 14, 15, 16, 17, 18, 19, 20, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207 and 209, C.I. Pigment Violet 19, and C.I. Vat Reds 1, 2, 10, 13, 15, 23, 29 and 35.

Although the above-described pigment may be used by itself, it is preferable to improve visibility by combining a dye and a pigment from the viewpoint of the quality of a full-color image. Dyes for magenta include oil-soluble dyes, such as C.I. Solvent Reds 1, 3, 8, 23, 24, 25, 27, 30, 49, 81, 82, 83, 84, 100, 109 and 121, C.I. Disperse Red 9, C.I. Solvent Violets 8, 13, 14, 21 and 27, C.I. Disperse Violet 1, and basic dyes, such as C.I. Basic Reds, 1, 2, 9, 12, 13, 14, 15, 17, 18, 22, 23, 24, 27, 29, 32, 34, 35, 36, 37, 38, 39 and 40, C.I. Basic Violets 1, 3, 7, 10, 14, 15, 21, 25, 26, 27 and 28.

Coloring pigments for cyan include C.I. Pigment Blues 2, 3, 15, 16 and 17, C.I. Vat Blue 6, C.I. Acid Blue 45, and copper phthalocyanine pigments obtained by replacing a phthalocyanine skeleton with 1–5 phthalimide groups.

Coloring pigments for yellow include Pigment Yellows 1, 2, 3, 4, 5, 6, 7, 10, 11, 12, 13, 14, 15, 16, 17, 23, 65, 73 and 83, and C.I. Vat Yellows 1, 3 and 20.

The amount of use of the coloring agent is within a range of 1–15 weight parts with respect to 100 weight parts of the binding resin, preferably within a range of 3–12 weight parts, and more preferably within a range of 4–10 weight parts.

When the contained amount of the coloring agent exceeds 15 weight parts, transparency decreases, the reproducibitity of an intermediate color represented by the skin color of the human being tends to be degraded, the stability of the charging property of the toner is degraded, and the target amount of charging cannot be easily obtained.

When the contained amount of the coloring agent is less than 1 weight part, the target tinting strength cannot be easily obtained, and a high-quality image having a high density cannot be easily obtained.

When using the toner of the present invention as a magnetic toner, magnetic toner particles include a magnetic material, which also operates as a coloring agent. The magnetic materials include iron oxides, such as magnetite, magnetic hematite, and ferrite, iron oxides including other metal oxides, metals, such as Fe, Co and Ni, alloys of at least one of these metals and at least one of other metals, such as Al, Co, Cu, Pb, Mg, Ni, Sn, Zn, Sb, Be, Bi, Cd, Ca, Mn, Se, Ti, W and V, and mixtures of these materials.

More specifically, the magnetic materials include triiron tetraoxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), and nickel powder (Ni). One or more of the above-described magnetic materials are used. Particularly suitable magnetic materials are fine powders of triiron tetraoxide or $\gamma$-diiron trioxide.

It is preferable that these magnetic materials have a number average particle diameter within a range of 0.1–2 $\mu$m (more preferably within a range of 0.1–0.5 $\mu$m), and magnetic properties at a magnetic field of 796 kA/m (10 kOe), of a coercive force within a range of 1.59–11.9 kA/m (20–150 oersteds), a saturation magnetization within a range of 50–200 emu/g (more preferably within a range of 50–100 emu/g), and a residual magnetization within a range of 2–20 emu/g.

10–200 mass parts, preferably 20–150 mass parts, of the magnetic material may be used with respect to 100 mass parts of the binding resin.

In the present invention, at least one type of releasing agent may be contained in the toner particles, if necessary.

The releasing agents include aliphatic hydrocarbon waxes, such as low-molecular-weight polyethylene, low-molecular-weight polypropylene, microcrystalline wax, and paraffin wax, aliphatic hydrocarbon wax oxides, such as polyethylene oxide wax, and block copolymers of these compounds, waxes having fatty acid ester as a main component, such as carnauba wax, SASOL wax, and montanonic acid ester wax, and materials obtained by deoxidizing a part or the entirety of fatty acid esters, such as deoxidized carnauba wax. The releasing agents also include saturated straight-chain fatty acids, such as palmitic acid, stearic acid, montanic acid, and long-chain alkyl carboxylic acids having long-chain alkyl groups, unsaturated fatty acids, such as brassidic acid, eleostearic acid and parinaric acid, saturated alcohols, such as stearyl alcohol, aralkyl alcohol, behenyl alcohol, carnaubyl alcohol, ceryl alcohol, melissyl alcohol, and long-chain alkyl alcohols having long-chain alkyl groups, polyhydric alcohols, such as sorbitol, fatty acid amides, such as linoleic acid amide, oleic acid amide and lauric acid amide, saturated fatty acid bisamides, such as methylenebis stearic acid amide, ethylenebis caprylic acid amide, ethylenebis lauric acid amide, and hexamethylenebis stearic acid amide, unsaturated fatty acid amides, such as ethylenebis oleic acid amide, hexamethylenebis oleic acid amide, N,N'-dioleyladipic acid amide, and N,N'-dioleyl sebacic acid amide, aromatic bisamides, such as m-xylenebis stearic acid amide, and N,N'-distearyl isophthalic acid amide, fatty acid metal salts (generally called metallic soaps), such as calcium stearate, calcium laurate, zinc stearate, and magnesium stearate, waxes each obtained by grafting aliphatic hydrocarbon wax using a vinyl-type monomer such as styrene or acrylic acid, each partially esterified compound of a fatty acid and a polyhydric alcohol, such as behenic acid monoglyceride, and methyl ester compounds having hydroxyl groups obtained by adding hydrogen atoms to a vegetable oil.

Particularly, aliphatic alcohol waxes and aliphatic hydrocarbon waxes are preferably used as releasing agents.

A synthetic hydrocarbon wax obtained from a low-molecular-weight alkylene polymer obtained by synthesizing alkylene according to radical polymerization under high pressure or according to polymerization under low pressure using a Ziegler catalyst, an alkylene polymer obtained by performing thermal decomposition of a high-molecular-weight alkylene polymer, or a distillation residue of hydrocarbon obtained from a synthetic gas, including carbon monoxide and hydrogen, according to the Arge process, or by adding hydrogen to each of these compounds may be used as the aliphatic hydrocarbon wax. A product obtained by fractionating a hydrocarbon wax by utilizing a press sweating method, a solvent method or vacuum distillation, or according to a fractional crystallization method is more preferably used. A hydrocarbon synthesized according to reaction between carbon monoxide and hydrogen using a metal-oxide-type catalyst (in most cases, a multi-material type including at least two materials), such as a hydrocarbon having several hundreds of carbon atoms at maximum obtained according to a synthol process, a Hydrocol process (using a fluid catalyst bed, or the Arge process (using a fixed catalyst bed) in which many wax-like hydrocarbons are obtained, or a hydrocarbon obtained by polymerizing alkylene, such as ethylene, using a Ziegler catalyst is preferable as the hydrocarbon as a mother material, because such a hydrocarbon is a saturated straight-chain hydrocarbon having a small number of small branches. Particularly, a wax synthesized from carbon monoxide and hydrogen is preferable because of a narrow molecular-weight distribution.

It is preferable that a main peak in the molecular-weight distribution is present within a range of molecular weights of 400–2,400 (more preferably within a range of 450–2,000, and still more preferably within a range of 500–1,600). A wax having such a molecular-weight distribution can have thermal characteristics favorable for a toner.

The amount of the releasing agent is preferably within a range of 0.1–20 weight parts with respect to 100 weight parts of the binding resin, and more preferably within a range of 0.5–10 weight parts.

The releasing agent is contained in the bonding resin by dissolving the resin in a solvent, raising the temperature of the resin solution, and adding and mixing the releasing agent while being stirred, or by mixing the releasing agent during melt-kneading of the binding resin and the releasing agent.

It is preferable that a fluidity improving agent is added to toner particles from the viewpoint of improving the picture quality.

The fluidity of the toner particles is improved by adding the fluidity improving agent to the toner particles.

For example, fluorine-type-resin powder, such as vinylidene-fluoride fine powder, or polytetrafluoroethylene fine powder, silica fine powder, such as silica fine powder according to a wet process, or silica fine powder according to a dry process, processed-silica fine powder obtained by performing surface treatment of the above-described silica fine powder using a processing agent, such as a silane coupling agent, titanium coupling agent or silicone oil, titanium-oxide fine powder, alumina fine powder, processed-titanium-oxide fine powder, or processed aluminn oxide fine powder may be used as the fluidity improving agent.

A fluidity improving agent having a specific surface area due to nitrogen adsorption measured according to the BET (Brunauer-Emmett-Teller) method of at least 30 $cm^2/g$, and more preferably at least 50 $cm^2/g$, provides excellent results. The fluidity improving agent may be used within a range of 0.01–8 weight parts with respect to 100 weight parts of toner particles, and more preferably within a range of 0.1–4 weight parts.

Toner particles having a predetermined average particle diameter can be formed by sufficiently mixing a binding resin, a coloring agent, a metal salicylate compound, and other additive agents having arbitrary components, using a mixing machine, such as a Henschel mixer or a ball mill, melting, kneading and milling the obtained mixture using a kneading machine, such as a kneader or an extruder, cooling and solidifying the fused mixture, pulverizing the solidified mixture, and classifying the pulverized mixture.

Although the method of adding the hindered phenol is not limited to a specific method, it is preferable that the hindered phenol is contained in the binding resin during synthesis of the binding resin. It is also preferable to add the hindered phenol during mixture simultaneously with other components.

It is also possible to obtain a toner having a fluidity improving agent on the surfaces of toner particles by sufficiently mixing the fluidity improving agent and the toner particles using a mixing machine, such as a Henschel mixer.

In the present invention, the weight-average particle diameter ($D_4$) of the toner is within a range of 3.0–15.0 $\mu$m, and more preferably within a range of 4.0–12.0 $\mu$m.

When the weight average particle diameter ($D_4$) is less than 3.0 $\mu$m, stability in charging is hardly achieved, and fog and the dispersion of toner tend to occur during repeated image forming operations.

When the weight-average particle diameter ($D_4$) of the toner exceeds 15.0 $\mu$m, reproducibility of a halftone portion is greatly degraded, and the obtained image becomes a coarse image.

The volume-average particle diameter ($D_v$) of the toner of the present invention is preferably within a range of 2.5–6.0 $\mu$m in order to form a high-quality image.

When the volume average particle diameter ($D_v$) of the toner is less than 2.5 $\mu$m, stability in charging of the toner is degraded. When the volume average particle diameter ($D_v$) of the toner exceeds 6.0 $\mu$m, the picture quality tends to become coarse.

A method for forming a full-color image according to an electrophotographic method by applying the toner of the present invention will now be described with reference to FIG. 3.

Figure 3:
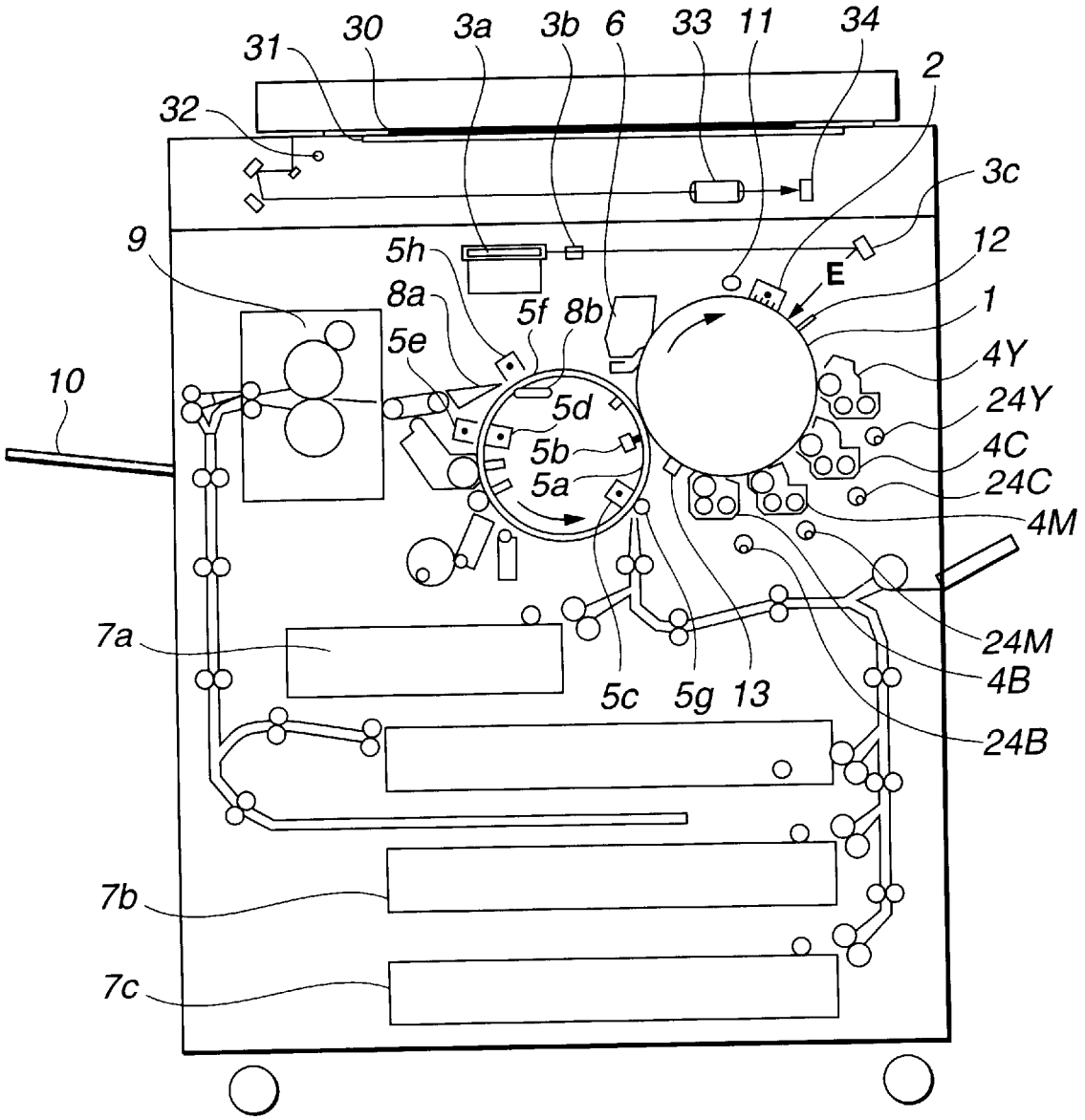
FIG. 3 is a schematic diagram illustrating the configuration of an image forming apparatus which can use the toner of the present invention.

FIG. 3 is a schematic diagram illustrating the configuration of an image forming apparatus for forming a full-color image according to an electrophotographic method. The image forming apparatus shown in FIG. 3 is used as a full-color copy machine or a full-color printer. In the case of the full-color copy machine, as shown in FIG. 3, a digital color-image reader unit and a digital color-image printer unit are provided at an upper portion and at a lower portion, respectively.

In the image reader unit, by mounting an original 30 on original-mount glass 31, and performing scanning exposure of the surface of the original 30 by an exposure lamp 32, a reflected-light image from the original 30 is focused onto a full-color sensor 34 by a lens 33, to obtain a color-separation image signal. The color-separation image signal is processed by a video processing unit (not shown) after passing through an amplification circuit (not shown), and is transmitted to the digital image printer unit.

In the image printer unit, a photosensitive drum 1, serving as an image bearing member, includes a photosensitive layer made, for example, of an organic photoconductor, and is supported so as to be rotatable in the direction of an arrow. A pre-exposure lamp 11, a corona charger 2, a laser exposure optical system 3, a potential sensor 12, four developing units 4Y, 4C, 4M and 4B for four different colors, means 13 for detecting the amount of light on the photosensitive drum 1, a transfer device 5, and a cleaning unit 6 are disposed around the photosensitive drum 1.

In the laser exposure optical system 3, the image signal from the image leader unit is converted into an optical signal for image scanning exposure by a laser output unit (not shown). A laser beam representing the optical signal is reflected by a polygonal mirror 3*a,* and is projected onto the surface of the photosensitive drum 1 via a lens 3*b* and a mirror 3*c*.

During image formation, the image printer unit causes the photosensitive drum 1 to rotate in the direction of the arrow. After removing charges on the photosensitive drum 1 by the pre-exposure lamp 11, the photosensitive member 1 is uniformly charged to a negative potential by the charger 2. By projecting an optical image E for each separation color, an electrostatic latent image is formed on the photosensitive drum 1.

Then, the electrostatic latent image on the photosensitive drum 1 is developed by operating the corresponding developing unit, to form a toner image by the toner on the photosensitive drum 1. The developing units 4Y, 4C, 4M and 4B selectively approach the photosensitive drum 1 in accordance with respective separation colors by operations of eccentric cams 24Y, 24C, 24M and 24B, respectively, in order to perform development.

The transfer device 5 includes a transfer drum 5*a,* a transfer charger 5*b,* an attraction charger 5*c* for electrostatically attracting a recording material, an attraction roller 5*g* facing the attracting charger 5*c,* an inside charger 5*d,* an outside charger 5*e,* and a separation charger 5*h*. The transfer drum 5*a* is supported so as to be rotatably driven. A transfer sheet 5*f,* serving as a transfer-material carrying member for carrying a transfer material, is integrally provided around the circumferential surface of the transfer drum 5*a*. A resin film, such as a polycarbonate film, is used as the transfer sheet 5*f*.

A transfer material is conveyed from a cassette 7*a,* 7*b* or 7*c* to the transfer drum 5*a* passing through a transfer-sheet conveying system, and is carried on the transfer drum 5*a*. The transfer material carried on the transfer drum 5*a* is conveyed to a transfer position facing the photosensitive drum 1 in accordance with the rotation of the transfer drum 5*a*. The toner image on the photosensitive drum 1 is transferred onto the transfer material by the operation of the transfer charger 5*b* while the transfer material passes through the transfer position. Toner particles remaining on the photosensitive drum 1 without being transferred during the image transfer are removed by the cleaning device 6.

The toner image may be directly transferred from the photosensitive member to the transfer material, or may be first transferred onto an intermediate transfer member and then again transferred from the intermediate transfer member onto the transfer material.

By repeating the above-described image forming process for yellow (Y), magenta (M), cyan (C) and black (B), a color image as a result of superposing toner images of the four colors is obtained on the transfer material on the transfer drum 5.

The transfer material on which the toner images of the four colors have been transferred in the above-described manner is separated from the transfer drum 5*a* by the operations of a separation pawl 8*a,* a separation raising roller 8*b* and the separation charger 5*h,* and is transferred to a heating/pressing fixing unit 9. Color mixture and coloring of the toner, and fixing of the toner on the transfer material are performed by performing heating/pressing fixing at the heating/pressing fixing unit 9, to provide a full-color fixed image. The transfer material having the full-color fixed image thereon is discharged onto a tray 10. Thus, the formation of a full-color image is terminated.

At that time, the speed of the fixing operation at the heating/pressing fixing unit 9 is set to a value (for example, 90 mm/sec) lower than the process speed (for example, 160 mm/sec) of the main body of the apparatus. This is because, when performing color mixture by fusing an unfixed image formed by two to four layers of toners, it is necessary to provide the toners with a sufficient amount of heating. By fixing the image at a speed smaller than the developing speed, the amount of heating for the toners is increased.

Figure 4:
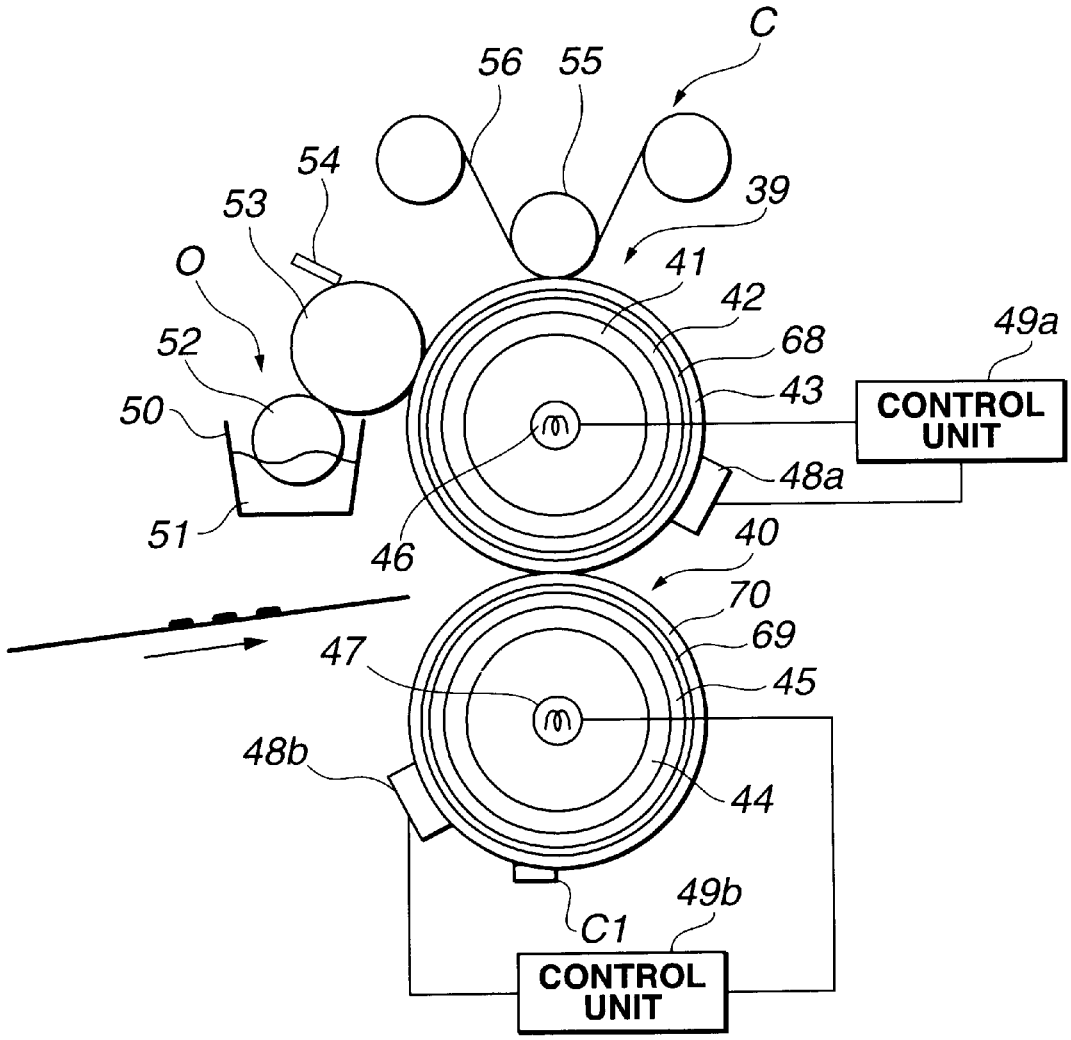
FIG. 4 is a schematic diagram illustrating an example of heating/pressing fixing means.

In FIG. 4, a fixing roller 39, serving as fixing means, includes, for example, an RTV(room-temperature vulcanization)-type-silicone-rubber layer 42 having a thickness of 2 mm formed on an aluminum core 41 having a thickness of 5 mm, a fluorine-rubber layer 68 having a thickness of 50 $\mu$m formed on the layer 42, and an HTV (high-temperature vulcanization)-type-silicone-rubber layer 43 formed on the layer 68. The fixing roller 39 has a diameter of 60 mm.

A pressing roller 40, serving as pressing means, includes, for example, an RTV-type-silicone-rubber layer 45 having a thickness of 2 mm formed on an aluminum core 44 having a thickness of 5 mm, a fluorine-rubber layer 69 having a thickness of 50 $\mu$m formed on the layer 45, and an HTV-type-silicone-rubber layer 70 having a thickness of 230 $\mu$m formed on the layer 45. The pressing roller 40 has a diameter of 60 mm.

A halogen heater 46, serving as heating means, is disposed within the fixing roller 39, and a halogen heater 47 is disposed within the core of a pressing roller 40, in order to heat the transfer material from two sides. The temperatures of the fixing roller 39 and the pressing roller 40 are detected by thermistors 48*a* and 48*b* contacting the fixing roller 39 and the pressing roller 40, respectively. The halogen heaters 46 and 47 are controlled by control devices 49*a* and 49*b*, respectively, based on the detected temperatures, so that the temperatures of the fixing roller 39 and the pressing roller 40 are maintained to respective constant temperatures (for example, within a range of 160° C.±10° C.). The fixing roller 39 and the pressing roller 40 are pressed by a pressing mechanism (not shown) with a total pressure of about 40 kg.

In FIG. 4, there are shown an oil coating device O, serving as releasing-agent coating means, a cleaning device C, and a cleaning blade C1 for removing oil and contamination adhering to the pressing roller 40. The oil coating device O coats dimethylsilicone oil 51 (for example, KF96 300 cSt made by Shin-Etsu Chemical Co., Ltd.) within an oil pan 50 onto the fixing roller 39 via an oil drawing roller 52 and an oil coating roller 53 by regulating the amount of coated oil by an oil-coating-amount adjusting blade 54.

The cleaning device C performs cleaning by pressing a nonwoven fabric clock web 56 made of Nomex (trade name) against the fixing roller 39 by a pressing roller 55. The web 56 is appropriately wound up by a winding device (not shown), in order to prevent accumulation of the toner, and the like, at a contact portion with the fixing roller 39.

Since the toner of the present invention has excellent low-temperature fixability and high-temperature-offset resisting property, it is possible to reduce the amount of coating of the releasing agent. Accordingly, the amount of contamination of the cleaning device is small.

The toner image using the toner of the present invention may be subjected to heating/pressing fixing under the condition of the surface temperature of the fixing roller within a range of 150° C.±30° C.

According to the above-described image forming process, by fixing a color toner image including at least the toner of the present invention on a recording material, a color image formed on the recording material can be obtained.

Methods for measuring physical properties of the binding resin and toner particles will now be described.

(1) Measurement of the percentage content of the hindered phenol

The determination of the percentage content of the hindered phenol using a gas chromatograph mass spectrometer (GC-MS) is performed according to the following manner.

Thermal decomposition of a sample is performed using an apparatus TRACE 2000 series (made by Thermo Quest Corporation), and a type Rtx-5MS is used as a capillary.

An apparatus VOYGER (made by Thermo Quest Corporation) is used for mass spectrometry column.

A sample solution obtained by dissolving 0.5 mg of the hindered phenol to be determined in 100 ml of methanol, and a sample solution obtained by diluting the above-described solution by 10 times are prepared, and a working curve is formed from spectra obtained by performing thermal decomposition of 1.0 $\mu$l of each of the solutions at the following rate of temperature rise.

(the rate of temperature rise)

50° C.: holding for 1 minute

50° C.–70° C.: 2° C./min

70° C.–150° C.: 5° C./min

150° C.–250° C.: 10° C./min 1.0 g of the toner is dissolved in 20 ml of a chloroform solution. Then, after sufficiently dissolving 20 ml of a methanol solution while slowly dripping it, the resultant solution is left in still standing for one day. 1.0 $\mu$l of a supernatant liquid after precipitating other materials contained in the toner is subjected to thermal decomposition.

The percentage content of the hindered phenol contained in the toner is calculated from the detected spectra peculiar to the sample and the previously formed working curve.

(2) Measurement of the storage modulus of the toner

The storage modulus G' within a temperature range of 60–210° C. is measured under the following conditions using a viscoelasticity measuring apparatus (rheometer) RDA-II (made by Rheometrics Corporation).

Measuring jig:

When the modulus of elasticity is large, a flat circular plate having a diameter of 7.9 mm is used. When the modulus of elasticity is small, a flat circular plate having a diameter of 40 mm is used. A shallow cup corresponding to the circular plate is used at the side of an actuator. The interval between the base of the shallow cup and the circular plate is about 2 mm.

Sample to be measured:

After heating and fusing the toner, the toner is used by being formed into a disc-haped sample having a diameter of about 8 mm and a height of 2 mm, or a disc-shaped sample having a diameter of about 40 mm and a height of 2 mm.

Measuring frequency: 6.28 radian/sec

Setting of distortion to be measured:

After setting the initial value to 0.1%, measurement is performed in an automatic measuring mode.

Correction of expansion of the sample:

Adjustment is performed in the automatic measuring mode.

Measuring temperature:

Temperature is raised at a rate of 2° C. per minute within a range of 60–210° C.

(3) Measurement of the molecular weight according to GPC

The molecular weight of chromatogram according to gel permeation chromatography is measured under the following conditions.

The column is stabilized within a heat chamber maintained at 40° C. Tetrahydrofuran (THF), serving as a solvent, is flown in the column maintained at the above-described temperature at a flow rate of 1 ml per minute, and measurement is performed by injecting a THF sample solution of the resin adjusted to a sample density of 0.05–0.6 weight % into the THF. In the measurement of the molecular weight of the sample, the molecular-weight distribution of the sample is calculated from the relationship between the logarithmic value of a working line formed using several types of monodisperse polystyrene reference samples and the count value. For example, samples having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ made by Pressure Chemical Co. or Tosoh Corporation are used as the reference polystyrene sample for forming a working curve. It is adequate to use at least about ten reference polystyrene samples. An RI (refractive index) detector is used as a detector.

In order to precisely measure a molecular-weight region within a range of $10^3$–$2\times10^6$, it is preferable to combine a plurality of commercially available polystyrene columns. For example, a combination of $\mu$-styragels 500, $10^3$, $10^4$ and $10^5$ made by Waters Corporation, or a combination of shodex's KA-801, 802, 803, 804, 805, 806 and 807 made by Showa Denko K.K. is preferable.

(4) Measurement of the glass transition temperature (Tg)

Measurement is performed according to ASTM D3418-82 using a differential-thermal-analysis measuring apparatus (DSC measuring apparatus) DSC-7 (made by Perkin Elmer Corporation).

5–20 mg, preferably 10 mg, of a sample to be measured is precisely weighed.

This sample is put into an aluminum pan. A vacant pan is used as a reference, and measurement is performed within a temperature range of 30–200° C. at a rate of temperature rise of 10° C./min in an ordinary temperature/ordinary humidity environment.

An endothermic peak, serving as a main peak, within a temperature range of 40–100° C. is obtained in this temperature rise process.

A cross point of a line at an intermediate point on the base line before and after the appearance of this endothermic peak and a differential thermal curve is made a glass transition temperature Tg.

(5) Measurement of toner particles or the particle-size distribution of the toner A Coulter counter TA-II or a Coulter multisizer II (made by Coulter Electronics Inc.) is used as the measuring apparatus. An aqueous solution of about 1% of NaCl is prepared as the electrolytic solution, using a first-grade sodium chloride. For example, ISOTON (trade name)-II (made by Coulter Scientific Japan Co.) may be used. 0.1–5 ml of a surface-active agent (preferably alkyl benzene sulfonate salt) is added as a dispersing agent in 100–150 ml of the above-described electrolytic solution, and 2–20 mg of the sample to be measured is added. The electrolytic solution in which the sample is suspended is dispersed for about 1–3 minutes using an ultrasonic dispersion apparatus. The volume distribution and the number distribution of the toner is calculated by measuring the volume and the number of toner particles for each channel by the above-described measuring apparatus using an aperture having a diameter of 100 $\mu$m. The weight-average particle diameter (D4) and the volume-average particle diameter (Dv) (a central value at each channel is made a representative value for the channel) of toner particles with reference to the weight are obtained from the volume distribution of the toner particles.

13 channels, i.e., 2.00–2.52 $\mu$m; 2.52–3.17 $\mu$m; 3.17–4.00 $\mu$m; 4.00–5.04 $\mu$m; 5.04–6.35 $\mu$m; 6.35–8.00 $\mu$m; 8.00–10.08 $\mu$m; 10.08–12.70 $\mu$m; 12.70–16.00 $\mu$m; 16.00–20.20 $\mu$m; 20.20–25.40 $\mu$m; 25.40–32.00 $\mu$m; and 32.00–40.30 $\mu$m are used. Each of the channels does not include the upper limit thereof.

(6) Determination of a tetrahydrofuran(THF)-insoluble component 2 g of a resin or a toner is precisely weighed (TW1), is placed on a cylindrical filter (for example, No. 86R made by Toyo Roshi Kabushiki Kaisha), and is put into a Soxlet extractor, 200 ml of THF is used. The sample is subjected to reflux for 10 hours using an oil bus adjusted to a temperature of about 120° C. A THF-soluble component (W1) can be determined by performing vacuum drying of the THF at 60° C. for 24 hours after condensing an drying the THF. When determining a THF-insoluble component (W2) of the toner, the component is calculated from a THF-insoluble component (TW2) other than the binding resin, such as the coloring agent (magnetic material), and the like, according to the following equation:

$$\text{THF-insoluble component } (W2)=\{TW1-(TW2+W1)\}/(TW1-TW2)\times 100.$$

(7) Determination of the acid value (JIS (Japanese Industrial Standards) acid value)

2–10 g of a sample is weighed and is put into an Erlenmeyer flask having a volume of 200–300 ml, and the resin is dissolved by adding about 50 ml of a mixed solvent including methanol and toluene with a ratio of 30:70. A small amount of acetone may be added if solubility is inferior. Using an indicator including 0.1% of Bromthymol Blue and Phenol Red, titration is performed using a previously standardized 0.1 mol/l potassium-hydroxide/alcohol solution, and the acid value is obtained from the consumed amount of the solution according to the following calculation:

$$\text{Acid value}=\text{KOH(ml)}\times N\times 5.61/\text{the weight of the sample},$$

where N is a factor of 0.1 mol/l KOH.

EXAMPLES

Examples of the manufacture of the binding resin and the toner, and examples of the toner of the present invention will now be described. However, the present invention is not limited to these examples.

Example 1 of the Manufacture of the Resin

A diol component represented by the following formula: 10 mol %

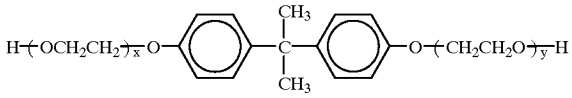

(the average value of x+y=2.1).

Fumaric acid: 10 mol %

Under the presence of 4-t-butylcatechol (termed a "compound I"), serving as a hindered phenol, a linear prepolymer having a number-average molecular weight (Mn) of 850 was formed by performing polycondesation with the above-described monomer.

Then, nonlinear polyester resin No. 1 was obtained by performing polycondensation by mixing the linear prepolymer and the following monomer. The 4-t-butylcatechol was provided so as to be 0.02 weight parts with respect to 100 weight parts of the entire monomer component.

A diol component represented by the following formula: 4 mol %

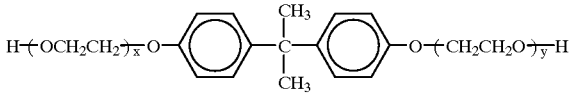

(the average value of x+y=2.1)

A diol component represented by the following formula: 37 mol %

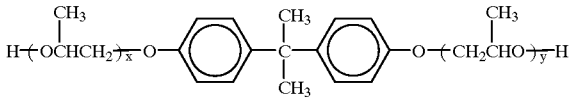

(the average value of x+y=2.3)

Fumaric acid: 27 mol %

Terephthalic acid: 11 mol %

Trimellitic acid: 1 mol %

The obtained nonlinear polyester resin No. 1 had a Tg of 58 C., a contained amount of the THF-insoluble component of 7 weight %, and Mn of 3,100, Mw of 10,850 and Mw/Mn of 3.5 in GPC of the THF-soluble component. The acid value of the polyester resin was 15 mg KOH/g, and was confirmed to have carboxylic groups by means of IR.

Example 2 of the Manufacture of the Resin

A diol component represented by the following formula: 51 mol %

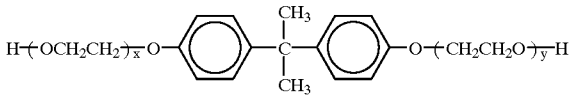

(the average value of x+y=3.0)

Fumaric acid: 21 mol %

Terephthalic acid: 11 mol %

Trimellitic acid: 9 mol %

Under the presence of 4-t-butylcatechol, nonlinear polyester resin No. 8 was obtained by performing polycondensation with the above-described monomer. The di-t-butylcatechol was provided so as to be 0.1 weight part with respect to 100 weight parts of the entire monomer component.

The obtained nonlinear polyester resin No. 8 had a Tg of 56° C., a contained amount of the THF-insoluble component of 10 mass %, and Mn of 4,500 Mw of 47,250 and Mw/Mn of 10.5 in GPC of the THF-soluble component. The acid value of the polyester resin was 12 mg KOH/g, and was confirmed to have carboxylic groups by means of IR.

Example 3 of the Manufacture of the Resin

A diol component represented by the following formula: 15 mol %

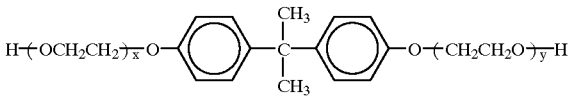

(the average value of x+y=5.1)

A diol component represented by the following formula: 38 mol %

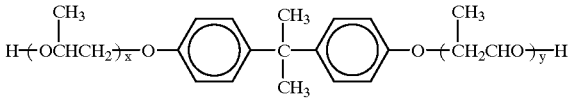

(the average value of x+y=2.1)

Fumaric acid: 39 mol %

Terephthalic acid: 11 mol %

Trimellitic acid: 1 mol %

Under the presence of 4-t-butylcatechol, nonlinear polyester resin No. 9 was obtained by performing polycondensation with the above-described monomer. The di-t-butylcatechol was provided so as to be 0.2 weight parts with respect to 100 weight parts of the entire monomer component.

The obtained nonlinear polyester resin No. 9 had a Tg of 56° C., a contained amount of the THF-insoluble component of 5 weight %, and Mn of 1,250, Mw of 8,370 and Mw/Mn of 6.7 in GPC of the THF-soluble component. The acid value of the polyester resin was 13 mg KOH/g, and was confirmed to have carboxylic groups by means of IR.

Example 1

Binding resin: polyester resin No. 1 100 weight parts

Charge control agent: Al di-tert-butylsalicylate compound 6 weight parts

Pigment: copper phthalocyanine 5 weight parts

The above-described materials were sufficiently subjected preliminary mixing using a Henschel mixer, and were melt-kneaded using a two-axle extruder. After cooling the mixture, the mixture was coarsely pulverized using a hammer mill to a size of about 1–2 mm, and then finely pulverized using a pulverizer according to an air-jet method. Both fine powder and coarse powder in the obtained finely pulverized matter were simultaneously removed strictly by classifying with a multisegment classifier, to obtain cyan color toner particles having a weight-average particle diameter of 7.8 μm.

By adding 1.5 weight % of titanium-oxide fine particles having a primary particle diameter of 50 nm subjected to surface treatment by isobutyltrimethoxysilane to the toner particles, cyan toner 1 was manufactured. The physical properties of cyan toner 1 are shown in Table 1.

Cyan toner 1 and magnetic ferrite carrier particles (having an average particle diameter of 50 μm) whose surfaces were coated with a silicone resin were mixed so that the toner density became 6 weight %, to provide two-component cyan developer 1.

By introducing the above-described two-component cyan developer 1 in a commercially available ordinary-paper full-color copy machine (a color laser copy machine CLC 700, made by Canon Inc.), a durability test of image formation for 20,000 sheets was performed in a mono-color mode under environments of an ordinary temperature and an ordinary humidity (23° C. and 60% RH), a low temperature and a low humidity (10° C. and 10% RH), and a high temperature and a high humidity (30° C. and 90% RH).

The results of the test are shown in Table 2.

The evaluation items are as follows.

Images were formed by setting the development contrast potentials of the copy machine to 350 V in the environment of a low temperature and low humidity (10° C. and 10% RH), 300 V in the environment of an ordinary temperature and an ordinary humidity (23° C. and 60% RH), and 250 V in the environment of a high temperature and a high humidity (30° C. and 90% RH), and the density of each of the obtained images was measured using a Macbeth reflection density meter (made by Macbeth Corporation). Fog was evaluated by calculating the fog density (%) from the difference between the whiteness of a white portion of the copied image and the whiteness of the transfer paper measured by a "reflectometer" (made by Tokyo Denshoku Kabushiki Kaisha).

The dispersion of the toner was determined by visually checking the state of the inside of the apparatus after performing the durability test for 20,000 sheets.

The evaluation standards for the dispersion of the toner are as follows:

A: No toner dispersion within the apparatus

B: A very little amount of toner dispersion within the apparatus

C: A little amount of toner dispersion within the apparatus

D: A considerable amount of toner dispersions within the apparatus

In addition to the evaluation using the full-color copy machine, a test of fixing at a speed of 200 mm/sec was performed by taking out only the fixing unit from the main body of the apparatus, providing an external driving unit and a temperature control function. And long-term preservability was evaluated by leaving the sample toner for 3 months in an environment of 30° C. and 90% RH. The evaluation was performed by visually determining the level of coagulating property of the toner.

Evaluation standards for the coagulating property of the toner are as follows:

A: No coagulated substances are observed, and fluidity is superior.

B: No coagulated substances are observed.

C: Although a certain amount of coagulated substances are observed, they are soon loosened.

D: Coagulated substances are loosened by a developer stirring apparatus.

E: Coagulated substances are not completely loosened by the developer stirring apparatus.

The results of the test are shown in Table 3.

Example 2

Cyan toner 2 and developer 2 were prepared in the same manner as in Example 1, except that polyester resin No. 2, manufactured in the same manner as polyester resin No. 1 except for increasing the amount of di-t-butylcatechol added during the synthesis of the polyester resin to 0.04 mass part, was used. Evaluation was performed in the same manner as in Example 1. The results of evaluation are shown in Tables 1–3.

Example 3

Cyan toner 3 and developer 3 were prepared in the same manner as in Example 1, except that polyester resin No. 3, manufactured in the same manner as polyester resin No. 1 except for reducing the amount of 4-t-butylcatechol added during the synthesis of the polyester resin to 0.005 mass parts, was used. Evaluation was performed in the same manner as in Example 1. The results of evaluation are shown in Tables 1–3.

Example 4

Cyan toner 7 and developer 7 were prepared in the same manner as in Example 2, except that the amount of addition of the Al di-tert-butylsalicylate compound differed. Evaluation was performed in the same manner as in Example 1. The results of evaluation are shown in Tables 1–3.

Example 5

Cyan toner 8 and developer 8 were prepared in the same manner as in Example 2, except that the amount of addition of Al di-tert-butylsalicylate compound differed. Evaluation was performed in the same manner as in Example 1. The results of evaluation are shown in Tables 1–3.

Example 6

Cyan toner 9 and developer 9 were prepared in the same manner as in Example 1, except that polyester resin No. 6, manufactured in the same manner as polyester resin No. 1, except that 2,5-di-tert-butylhydroquinone (termed a "compound II") was used in stead of 4-t-butylcatechol added during the synthesis of the polyester resin, and that 4 weight parts of a Cr di-tert-butylsalicylate compound was added instead of the Al di-tert-butylsalicylate compound, was used. Evaluation was performed in the same manner as in Example 1. The results of the evaluation are shown in Tables 1–3.

Example 7

Cyan toner 15 and developer 15 were prepared in the same manner as in Example 1, except that polyester resin No. 10, manufactured in the same manner as polyester resin No. 1 except for not adding 4-t-butylcatechol during the synthesis of the resin, was used, and that the 4-t-butylcatechol was preliminarily mixed with the binding resin, the charge control agent and the pigment. Evaluation was performed in the same manner as in Example 1. The results of the evaluation are shown in Tables 1–3.

Example 8

Cyan toner 16 and developer 16 were prepared in the same manner as in Example 1, except that polyester resin No. 1 containing 4-t-butycatechol was used, and that 4-t-butylcatechol was added during preliminary mixture of the binding resin, the charge control agent and the pigment. Evaluation was performed in the same manner as in Example 1. The results of the evaluation are shown in Tables 1–3.

Comparative Example 1

Cyan toner 4 and developer 4 were prepared in the same manner as in Example 1, except that polyester resin No. 4, manufactured in the same manner except for increasing the amount of 4-t-butylcatechol added during the synthesis of polyester resin No. 1 to 0.05 weight parts, was used. Evaluation was performed in the same manner as in Example 1. The results of the evaluation are shown in Tables 1–3.

Since the amount of 4-t-butylcatechol added during the synthesis of the polyester resin is large and the contained amount within the toner was too large, cross-linking (loose ionic bond) during melt-kneading with the polyester resin having carboxylic groups as in the present invention and the metal salicylate compound was hindered, thereby causing high-temperature offset. Many Coagulated bodies of the toner, serving as a measure for the long-term preservability of the obtained toner, were observed.

Comparative Example 2

Cyan toner 5 and developer 5 were prepared in the same manner as in Example 1, except that polyester resin No. 5, manufactured in the same manner except for reducing the amount of 4-t-butylcatechol added during the synthesis of polyester resin No. 1 to 0.002 weight parts, was used. Evaluation was performed in the same manner as in Example 1. The results of the evaluation are shown in Tables 1–3.

Since the amount of the hindered phenol added during the synthesis of the polyester resin was small, and the amount contained in the toner was insufficient, particularly, the amount of charging during a durability test in an environment of a high temperature and a high humidity decreased, and fog and the dispersion of the toner within the apparatus were observed.

Comparative Example 3

Cyan toner 6 and developer 6 were prepared in the same manner as in Example 2, except that the amount of addition of the Al di-tert-butylsalicylate compound differed. Evaluation was performed in the same manner as in Example 1. The results of the evaluation are shown in Tables 1–3.

Since the amount of addition of the Al di-tert-butylsalicylate compound was small, the formation of the ionic cross-linking structure of the polyester resin and the Al compound was insufficient. As a result, high-temperature offset occurred, and the long-term preservability of the toner was inferior. Since the amount of charging of the toner in the durability test was instable, problems, such as fog and the dispersion of the toner within the apparatus, arose.

Comparative Example 4

Cyan toner 10 and developer 10 were prepared in the same manner as in Example 4, except that polyester resin No. 7, manufactured in the same manner as polyester resin No. 1 except for using phenyl-α-naphthylamine (termed a "compound III"), serving as an amine-type antioxidant, instead of the 4-t-butylcatechol added during the synthesis of the polyester resin, was used. Evaluation was performed in the same manner as in Example 1. The results of the evaluation are shown in Table 1–3.

Comparative Example 5

Cyan toner 11 and developer 11 were prepared in the same manner as in Example 6, except that the charge control agent was not used at all. Evaluation was performed in the same manner as in Example 1. The results of the evaluation are shown in Table 1–3.

Since the ionic cross-linking structure during fusion and melt-kneading was not formed, high-temperature offset occurred, and the long-term preservability of the toner was inferior. In the durability test, since the amount of charging of the toner was instable, problems, such as fog and the dispersion of the toner within the apparatus, arose.

Comparative Example 6

Cyan toner 12 and developer 12 were prepared in the same manner as in Example 6, except that the amount of addition of Cr di-tert-butylsalicylate compound was increased. Evaluation was performed in the same manner as in Example 1. The results of the evaluation are shown in Tables 1–3.

Since the amount of addition of the Cr di-tert-butylsalicylate compound was large, toner spent was generated at the carrier side, and the amount of charging became instable in the durability test. As a result, fog and the dispersion of the toner within the apparatus occurred.

Comparative Example 7

Cyan toner 13 and developer 13 were prepared in the same manner as in Example 6, except that polyester resin No. 8 manufactured in Example 2 of the manufacture of the resin was used, and that the amount of addition of the Cr di-tert-butylsalicylate compound differed. Evaluation was performed in the same manner as in Example 1. The results of the evaluation are shown in Tables 1–3.

Comparative Example 8

Cyan toner 14 and developer 14 were prepared in the same manner as in Example 6, except that polyester resin No. 9 manufactured in Example 3 of the manufacture of the resin was used, and that the amount of addition of the Cr di-tert-butylsalicylate compound differed. Evaluation was performed in the same manner as in Example 1. The results of the evaluation are shown in Tables 1–3.

TABLE 1

| | Toner No. | Binding resin: Type (No. of polyester resin) | Binding resin: THF-insoluble component (weight %) | Binding resin: Acid value (mgKOH/g) |
|---|---|---|---|---|
| Example 1 | Cyan toner 1 | No. 1 | 7 | 15 |
| Example 2 | Cyan toner 2 | No. 2 | 8 | 14 |
| Example 3 | Cyan toner 3 | No. 3 | 7 | 14 |
| Comparative Example 1 | Cyan toner 4 | No. 4 | 8 | 12 |
| Comparative Example 2 | Cyan toner 5 | No. 5 | 9 | 18 |
| Comparative Example 3 | Cyan toner 6 | No. 2 | 8 | 10 |
| Example 4 | Cyan toner 7 | No. 2 | 7 | 15 |
| Example 5 | Cyan toner 8 | No. 2 | 7 | 15 |
| Example 6 | Cyan toner 9 | No. 6 | 8 | 14 |
| Comparative Example 4 | Cyan toner 10 | No. 7 | 10 | 13 |
| Comparative Example 5 | Cyan toner 11 | No. 6 | 7 | 12 |
| Comparative Example 6 | Cyan toner 12 | No. 6 | 8 | 10 |
| Comparative Example 7 | Cyan toner 13 | No. 8 | 10 | 12 |
| Comparative Example 8 | Cyan toner 14 | No. 9 | 5 | 13 |
| Example 7 | Cyan toner 15 | No. 10 | 7 | 14 |
| Example 8 | Cyan toner 16 | No. 1 | 8 | 15 |

| Toner: Tg (° C.) | G' (° C.) min | Mn | Mw | Mw/Mn | THF-insoluble component (weight %) | Type of the charge control agent | % Content of the charge control agent (weight %) |
|---|---|---|---|---|---|---|---|
| 61 | 144 | 3360 | 12090 | 3.6 | 11 | salicylic acid (Al) | 5.40 |
| 63 | 140 | 3300 | 12110 | 3.7 | 12 | salicylic acid (Al) | 5.40 |
| 60 | 138 | 3280 | 11990 | 3.7 | 13 | salicylic acid (Al) | 5.41 |
| 61 | — | 3230 | 11520 | 3.6 | 9 | salicylic acid (Al) | 5.40 |
| 60 | 140 | 3580 | 28500 | 8.0 | 14 | salicylic acid (Al) | 5.41 |
| 58 | — | 3120 | 10900 | 3.5 | 8 | salicylic acid (Al) | 0.08 |
| 60 | 158 | 2980 | 10620 | 3.6 | 8 | salicylic acid (Al) | 0.11 |
| 59 | 161 | 2820 | 11100 | 3.9 | 8 | salicylic acid (Al) | 0.14 |
| 59 | 150 | 3380 | 12100 | 3.6 | 11 | salicylic acid (Cr) | 3.67 |
| 60 | 155 | 3620 | 11250 | 3.1 | 12 | salicylic acid (Al) | 3.67 |
| 58 | — | 3130 | 10880 | 3.5 | 7 | | |
| 64 | 158 | 3410 | 12510 | 3.7 | 19 | salicylic acid (Cr) | 10.25 |
| 56 | — | 4470 | 56760 | 12.7 | 12 | salicylic acid (Cr) | 0.10 |
| 57 | — | 1480 | 10360 | 7.0 | 7 | salicylic acid (Cr) | 0.10 |
| 62 | 145 | 3820 | 26530 | 6.9 | 12 | salicylic acid (Al) | 3.67 |
| 63 | 145 | 3280 | 12150 | 3.7 | 10 | salicylic acid (Al) | 3.67 |

| Toner: Type of hindered phenol | Time of addition of hindered phenol | Percent Content of hindered phenol (ppm) | $H \times 10^4/S$ |
|---|---|---|---|
| (I) | during resin synthesis | 180 | 33 |
| (I) | during resin synthesis | 360 | 67 |
| (I) | during resin synthesis | 45 | 8 |
| (I) | during resin synthesis | 450 | 83 |
| (I) | during resin synthesis | 18 | 3 |
| (I) | during resin synthesis | 381 | 5000 |
| (I) | during resin synthesis | 380 | 3333 |
| (I) | during resin synthesis | 380 | 2667 |
| (II) | during resin synthesis | 183 | 50 |
| (III) | during resin synthesis | 367 | 100 |
| (II) | during resin synthesis | 550 | 5502 |
| (II) | during resin synthesis | 342 | 33 |
| (II) | during resin synthesis | 917 | 9166 |
| (II) | during resin synthesis | 1832 | 18315 |
| (I) | during material mixture | 183 | 50 |
| (I) | during synthesis and mixture | 183 | 50 |

TABLE 2

| | Initial | | | After printing 20,000 sheets | | |
|---|---|---|---|---|---|---|
| | Image density | Fog (%) | Toner dispersion | Image density | Fog (%) | Toner dispersion |
| Under ordinary temperature/humidity environment (23° C., 60% RH) | | | | | | |
| Example 1 | 1.70 | 0.3 | A | 1.69 | 0.4 | A |
| Example 2 | 1.75 | 0.3 | A | 1.72 | 0.4 | A |
| Example 3 | 1.72 | 0.5 | A | 1.68 | 0.4 | A |
| Example 4 | 1.77 | 0.5 | A | 1.61 | 0.6 | B |
| Example 5 | 1.78 | 0.6 | A | 1.71 | 0.7 | B |
| Example 6 | 1.67 | 0.4 | A | 1.59 | 0.5 | A |
| Example 7 | 1.65 | 0.3 | A | 1.60 | 0.4 | A |
| Example 8 | 1.75 | 0.3 | A | 1.71 | 0.5 | A |
| Comparative Example 1 | 1.66 | 1.2 | B | 1.38 | 2.5 | C |
| Comparative Example 2 | 1.71 | 0.7 | B | 1.69 | 2.1 | C |
| Comparative Example 3 | 1.78 | 1.8 | C | 1.75 | 3.9 | D |
| Comparative Example 4 | 1.67 | 0.5 | B | 1.61 | 2.1 | C |
| Comparative Example 5 | 1.65 | 1.3 | B | 1.41 | 2.6 | D |
| Comparative Example 6 | 1.45 | 0.6 | B | 1.52 | 3.8 | D |
| Comparative Example 7 | 1.64 | 1.1 | B | 1.22 | 2.4 | C |
| Comparative Example 8 | 1.65 | 1.1 | B | 1.72 | 3.8 | D |
| Under low temperature/humidity environment (10° C., 10% RH) | | | | | | |
| Example 1 | 1.65 | 0.9 | A | 1.60 | 1.2 | A |
| Example 2 | 1.68 | 0.9 | A | 1.65 | 1.3 | A |
| Example 3 | 1.63 | 0.8 | A | 1.60 | 1.3 | A |
| Example 4 | 1.72 | 1.0 | A | 1.77 | 1.8 | B |
| Example 5 | 1.71 | 0.9 | A | 1.70 | 1.9 | B |
| Example 6 | 1.65 | 0.9 | A | 1.62 | 1.7 | B |
| Example 7 | 1.60 | 0.7 | A | 1.55 | 1.5 | B |
| Example 8 | 1.63 | 0.8 | A | 1.61 | 1.6 | B |
| Comparative Example 1 | 1.61 | 1.5 | B | 1.58 | 3.1 | C |
| Comparative Example 2 | 1.62 | 1.1 | B | 1.55 | 2.8 | C |
| Comparative Example 3 | 1.69 | 2.1 | C | 1.65 | 4.2 | D |
| Comparative Example 4 | 1.61 | 1.1 | B | 1.52 | 2.9 | C |

TABLE 2-continued

| | Initial | | | After printing 20,000 sheets | | |
|---|---|---|---|---|---|---|
| | Image density | Fog (%) | Toner dispersion | Image density | Fog (%) | Toner dispersion |
| Comparative Example 5 | 1.58 | 1.4 | B | 1.35 | 3.3 | D |
| Comparative Example 6 | 1.32 | 0.8 | B | 1.39 | 4.1 | D |
| Comparative Example 7 | 1.61 | 1.4 | B | 1.19 | 2.9 | C |
| Comparative Example 8 | 1.55 | 1.5 | B | 1.66 | 3.3 | D |
| Under high temperature/humidity environment (30° C., 90% RH) | | | | | | |
| Example 1 | 1.73 | 0.6 | A | 1.72 | 0.7 | A |
| Example 2 | 1.72 | 0.7 | A | 1.70 | 0.9 | A |
| Example 3 | 1.73 | 0.8 | A | 1.69 | 1.0 | A |
| Example 4 | 1.78 | 0.9 | A | 1.72 | 1.2 | B |
| Example 5 | 1.77 | 0.8 | A | 1.69 | 1.1 | B |
| Example 6 | 1.69 | 0.5 | A | 1.65 | 0.8 | A |
| Example 7 | 1.71 | 0.6 | A | 1.66 | 1.6 | B |
| Example 8 | 1.72 | 0.8 | A | 1.65 | 1.5 | B |
| Comparative Example 1 | 1.71 | 1.1 | B | 1.68 | 2.5 | B |
| Comparative Example 2 | 1.72 | 1.1 | B | 1.67 | 3.1 | D |
| Comparative Example 3 | 1.74 | 2.5 | C | 1.78 | 3.9 | D |
| Comparative Example 4 | 1.71 | 1.2 | B | 1.72 | 3.2 | D |
| Comparative Example 5 | 1.65 | 1.2 | B | 1.46 | 3.2 | D |
| Comparative Example 6 | 1.45 | 0.9 | B | 1.52 | 4.3 | D |
| Comparative Example 7 | 1.72 | 0.9 | B | 1.45 | 3.5 | D |
| Comparative Example 8 | 1.61 | 1.2 | B | 1.68 | 3.1 | D |

TABLE 3

| | Fixing properties | | | Long-term preservability (after leaving for 3 months at 30° C., 90% RH) | | |
|---|---|---|---|---|---|---|
| | Fixing start temperature of an entirely black image (° C.) | High temperature offset start temperature (° C.) | Usable temperature range (° C.) | Image density | Fog (%) | Coagulating property of the toner |
| Example 1 | 105(1.69) | >210 | 105 | 1.68 | 0.8 | A |
| Example 2 | 105(1.72) | >210 | 105 | 1.71 | 0.9 | A |
| Example 3 | 105(1.72) | >210 | 105 | 1.65 | 0.9 | A |
| Example 4 | 105(1.73) | >210 | 105 | 1.69 | 0.9 | B |
| Example 5 | 105(1.74) | >210 | 105 | 1.65 | 0.7 | A |
| Example 6 | 105(1.65) | >210 | 105 | 1.71 | 1.0 | B |
| Example 7 | 110(1.68) | >210 | 100 | 1.66 | 1.1 | A |
| Example 8 | 110(1.71) | >210 | 100 | 1.65 | 0.9 | B |
| Comparative Example 1 | 120(1.65) | 180 | 60 | 1.38 | 3.8 | E |
| Comparative Example 2 | 110(1.71) | >210 | 100 | 1.61 | 1.2 | B |
| Comparative Example 3 | 125(1.75) | 185 | 60 | 1.41 | 2.9 | E |

TABLE 3-continued

| | Fixing properties | | | Long-term preservability (after leaving for 3 months at 30° C., 90% RH) | | |
|---|---|---|---|---|---|---|
| | Fixing start temperature of an entirely black image (° C.) | High temperature offset start temperature (° C.) | Usable temperature range (° C.) | Image density | Fog (%) | Coagulating property of the toner |
| Comparative Example 4 | 110(1.69) | 200 | 90 | 1.55 | 1.1 | B |
| Comparative Example 5 | 130(1.64) | 180 | 50 | 1.29 | 4.1 | E |
| Comparative Example 6 | 110(1.48) | 200 | 90 | 1.42 | 4.4 | D |
| Comparative Example 7 | 1.45(1.61) | 190 | 45 | 1.38 | 5.1 | E |
| Comparative Example 8 | 130(1.65) | 200 | 70 | 1.48 | 3.9 | E |

(Note) The numeral in each parenthesis in the column of the fixing start temperature of an entirely black image indicates the image density.

The individual components shown in outline or designated by blocks in the drawings are all well known in the toner and toner producing method arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A toner comprising at least:

a polyester resin having carboxyl groups;

a coloring agent;

0.1–10 weight % of a metal salicylate compound with respect to the total weight of said toner; and 20–400 ppm of a hindered phenol with respect to the total weight of said toner, wherein said toner has a minimum value ($G'_{min}$) within a region of 100–200° C. in a curve of a storage modulus; and when a content of said hindered phenol is represented by H, and a content of said metal salicylate compound is represented by S, a relationship of $$S:10^4 \times H = 1:5–1:4{,}000$$

is satisfied.

2. The toner according to claim 1, wherein said toner has a minimum value ($G'_{min}$) within a region of 110–170° C. in a curve of a storage modulus.

3. The toner according to claim 1, wherein said toner has a glass transition temperature within a range of 50–67° C., and has a minimum value ($G'_{min}$) within a region of 100–200° C. in a curve of a storage modulus.

4. The toner according to claim 1, wherein said toner has a number-average molecular weight (Mn) within a range of 1,500–10,000, a weight-average molecular weight (Mw) within a range of 6,000–100,000, and a ratio Mw/Mn within a range of 2–10, in a molecular-weight distribution according to gel permeation chromatography (GPC) of a tetrahydrofuran(THF)-soluble component.

5. The toner according to claim 1, wherein said toner includes 0.5–9 weight % of the metal salicylate compound with reference to the total weight of said toner.

6. The toner according to claim 1, wherein said metal salicylate compound is an aluminum salicylate compound.

7. The toner according to claim 1, wherein said metal salicylate compound is a metal compound of di-tert-butylsalicylic acid.

8. The toner according to claim 1, wherein said metal salicylate compound is an aluminum compound of di-tert-butylsalicylic acid.

9. The toner according to claim 1, wherein said hindered phenol is a catechol or substituted catechol hindered phenol.

10. The toner according to claim 1, wherein said hindered phenol is a hydroquinone or substituted hydroquinone hindered phenol.

11. The toner according to claim 1, wherein said hindered phenol is 4-tert-butylcatechol or 2,5-di-tert-butylhydroquinone.

12. The toner according to claim 1, wherein said hindered phenol is included within a range of 50–380 ppm.

13. A process for producing a toner containing at least toner particles, comprising:

a melt-kneading step for melt-kneading a mixture including at least a polyester resin having a carboxyl group and containing a hindered phenol, a coloring agent and a metal salicylate compound to obtain a melt-kneaded product, wherein said polyester resin is synthesized under the presence of a hindered phenol;

a cooling step for cooling the melt-kneaded product; and a pulverizing step for pulverizing the cooled product to obtain toner particles;

wherein said toner comprises at least said polyester resin having a carboxyl group; and said coloring agent; 0.1–10 weight % of the metal salicylate compound with respect to the total weight of the toner; and 20–400 ppm of the hindered phenol with respect to the total weight of the toner, wherein said toner has a minimum value ($G'_{min}$) within a region of 100–200° C., in a curve of a storage modulus;

and when a content of said hindered phenol is represented by H, and a content of said metal salicylate compound is represented by S, a relationship of $$S:10^4 \times H = 1:5-1:4,000$$

is satisfied.

14. The process according to claim 13, wherein the toner particles are obtained by classifying a pulverized product in the pulverizing step.

15. The process according to claim 13, wherein the mixture further includes a hindered phenol in addition to the polyester resin having a carboxylic group and containing the hindered phenol, the coloring agent and the metal salicylate compound.

16. The process according to claim 13, wherein the mixture includes 20–400 ppm of the hindered phenol with respect to the total weight of the toner.

17. The process according to claim 13, wherein the toner has a minimum value ($G'_{min}$) within a region of 110–170° C. in a curve of a storage modulus.

18. The process according to claim 13, wherein the toner has a glass transition temperature within a range of 50–67° C., and has a minimum value ($G'_{min}$) within a region of 100–200° C. in a curve of a storage modulus.

19. The process according to claim 13, wherein the toner has a number-average molecular weight (Mn) within a range of 1,500–10,000, a weight-average molecular weight (Mw) within a range of 6,000–100,000, and a ratio Mw/Mn within a range of 2–10, in a molecular-weight distribution according to gel permeation chromatograph (GPC) of a tetrahydrofuran(THF)-soluble component.

20. The process according to claim 13, wherein the toner includes 0.5– 9 weight % of the metal salicylate compound with reference to the total weight of said toner.

21. The process according to claim 13, wherein the metal salicylate compound is an aluminum salicylate compound.

22. The process according to claim 13, wherein the metal salicylate compound is a metal compound of di-tert-butylsalicylic acid.

23. The process according to claim 13, wherein the metal salicylate compound is an aluminum compound of di-tert-butylsalicylic acid.

24. The process according to claim 13, wherein the hindered phenol is a catechol or substituted catechol hindered phenol.

25. The process according to claim 13, wherein the hindered phenol is a hydroquinone or substituted hydroquinone hindered phenol.

26. The process according to claim 13, wherein the hindered phenol is 4-tert-butylcatechol or 2,5-di-tert-butylhydroquinone.

27. The process according to claim 13, wherein the hindered phenol is included within a range of 50–380 ppm.

28. A process for producing a toner containing at least a toner particles comprising:

a melt-kneaded step for melt-kneading a mixture including at least a hindered phenol, a polyester resin having a carboxyl group, a coloring agent and a metal salicylate compound to obtain a melt-kneaded product;

a cooling step for cooling the melt-kneaded product;

a pulverizing step for pulverizing the cooled product to obtain toner particles;

wherein said toner comprises at least said polyester resin having a carboxyl group; and said coloring agent; 0.1–10 weight % of the metal salicylate compound with respect to the total weight of the toner; and 20–400 ppm of the hindered phenol with respect to the total weight of the toner, wherein said toner has a minimum value ($G'_{min}$) within a region of 100–200° C. in a curve of a storage modulus; and when a content of said hindered phenol is represented by H, and a content of said metal salicylate compound is represented by S, a relationship of $$S:10^4 \times H = 1:5-1:4,000$$

is satisfied.

29. The process according to claim 28, wherein the toner particles are obtained by classifying a pulverized product in the pulverizing step.

30. The process according to claim 28, wherein the mixture includes 20–400 ppm of the hindered phenol with respect to the mass of the toner.

31. The process according to claim 28, wherein the toner has a minimum value ($G'_{min}$) within a region of 110–170° C. in a curve of a storage modulus.

32. The process according to claim 28, wherein the toner has a glass transition temperature within a range of 50–67° C., and has a minimum value ($G'_{min}$) within a region of 100–200° C. in a curve of a storage modulus.

33. The process according to claim 28, wherein the toner has a number-average molecular weight (Mn) within a range of 1,500–10,000, a weight-average molecular weight (Mw) within a range of 6,000–100,000, and a ratio Mw/Mn within a range of 2–10, in a molecular-weight distribution according to gel permeation chromatograph (GPC) of a tetrahydrofuran(THF)-soluble component.

34. The process according to claim 28, wherein the toner includes 0.5–9 weight % of the metal salicylate compound with reference to the total weight of said toner.

35. The process according to claim 28, wherein the metal salicylate compound is an aluminum salicylate compound.

36. The process according to claim 28, wherein the metal salicylate compound is a metal compound of di-tert-butylsalicylic acid.

37. The process according to claim 28, wherein the metal salicylate compound is an aluminum compound of di-tert-butylsalicylic acid.

38. The process according to claim 28, wherein the hindered phenol is a catechol or substituted catecol hindered phenol.

39. The process according to claim 28, wherein the hindered phenol is a hydroquinone or substituted hydroquinone hindered phenol.

40. The process according to claim 28, wherein the hindered phenol is 4-tert-butylcatechol or 2,5-di-tert-butylhydroquinone.

41. The process according to claim 28, wherein the hindered phenol is included within a range of 50–380 ppm.

* * * * *